US005494114A

United States Patent [19]

Hoening et al.

[11] Patent Number: 5,494,114

[45] Date of Patent: Feb. 27, 1996

[54] FIRE EXTINGUISHER SPRINKLER CONSTRUCTION

[75] Inventors: Brian T. Hoening, Standish; Kim P. Gordon, Sterling, both of Mich.

[73] Assignee: Globe Fire Sprinkler Corporation, Standish, Mich.

[21] Appl. No.: 181,843

[22] Filed: Jan. 18, 1994

Related U.S. Application Data

[62] Division of Ser. No. 1,062, Jan. 6, 1993, Pat. No. 5,299,645.

[51] Int. Cl.[6] ..... A62C 35/68

[52] U.S. Cl. ..... 169/38; 169/37

[58] Field of Search ..... 169/37, 38, 39, 169/40, 41, 90

[56] References Cited

U.S. PATENT DOCUMENTS

| | | | |
|---|---|---|---|
| 1,108,362 | 8/1914 | Hamilton . | |
| 1,482,260 | 1/1924 | Rowley . | |
| 1,571,422 | 2/1926 | Lubbock . | |
| 1,797,919 | 3/1931 | Loepsinger . | |
| 1,943,480 | 1/1934 | Hodgman, Jr. . | |
| 3,877,527 | 4/1975 | Johnson | 169/90 |
| 4,105,076 | 8/1978 | Simons et al. . | |
| 4,217,961 | 8/1980 | Wotton . | |
| 4,343,364 | 8/1982 | Glinecke | 169/42 X |
| 4,508,175 | 4/1985 | Pieczkolan . | |
| 4,609,047 | 9/1986 | Pieczykolan | 169/38 |
| 4,657,085 | 4/1987 | Jacobsen . | |
| 4,664,198 | 5/1987 | Johnson | 169/38 |
| 4,732,216 | 3/1988 | Polan | 169/38 |
| 4,830,115 | 5/1989 | Polan . | |
| 4,896,728 | 1/1990 | Wolff et al. | 169/37 |
| 4,898,246 | 2/1990 | Riedle et al. . | |
| 4,964,471 | 10/1990 | Michalik et al. | 169/37 X |
| 4,976,320 | 12/1990 | Polan . | |
| 4,981,179 | 1/1991 | Klein | 169/37 X |
| 5,022,468 | 6/1991 | Bryne | 169/40 |
| 5,083,616 | 1/1992 | Polan . | |

FOREIGN PATENT DOCUMENTS

| | | | |
|---|---|---|---|
| 2300434 | 7/1973 | Germany | 169/37 |
| 2206993 | 8/1973 | Germany | 169/41 |
| 2814017 | 10/1978 | Germany . | |
| 3225798 | 1/1984 | Germany . | |
| 2013559 | 8/1923 | United Kingdom . | |
| 333412 | 8/1930 | United Kingdom . | |
| 731200 | 6/1955 | United Kingdom . | |
| 1118526 | 7/1968 | United Kingdom . | |

*Primary Examiner*—David M. Mitchell
*Assistant Examiner*—Gary C. Hoge
*Attorney, Agent, or Firm*—Learman & McCulloch

[57] ABSTRACT

Fire extinguishing sprinkler apparatus comprises a frame for connection to a source of fire extinguishing fluid and having a passage through which such fluid may flow along a path. The passage normally is sealed by a closure in contact with the fluid. The closure is maintained in its passage sealing position by a retainer which is held by a collapsible strut in such position as to bear upon the closure. When ambient temperature rises to a predetermined level, the strut collapses enabling automatic expulsion of the closure from the passage and flow of fire extinguishing fluid through the passage. The closure is formed from material of poor thermal conductivity thereby preventing cooling of the collapsible strut by the transfer of heat from the strut through the closure to the fire extinguishing fluid in the passage. In one embodiment no part of the sprinkler frame lies in the path of fluid discharged from the sprinkler.

7 Claims, 2 Drawing Sheets

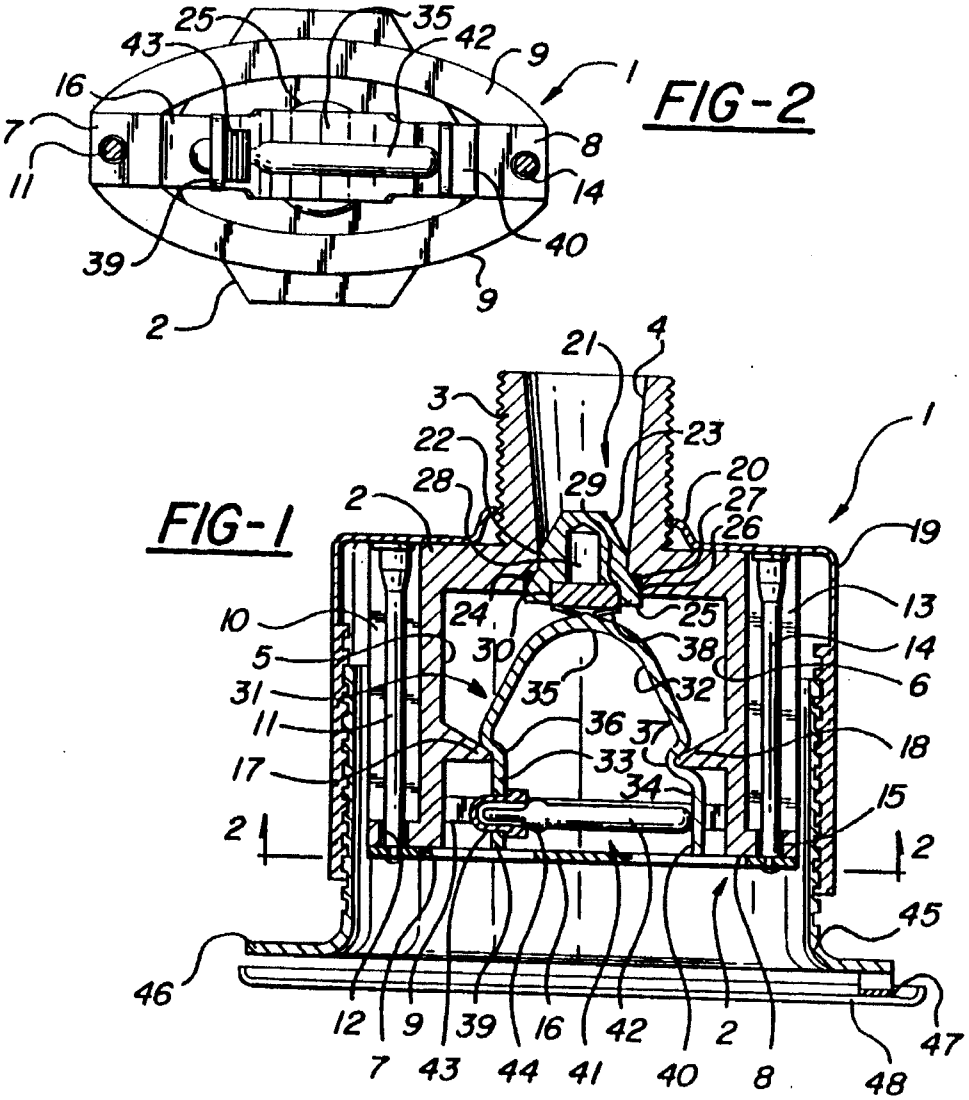
FIG-1
FIG-2
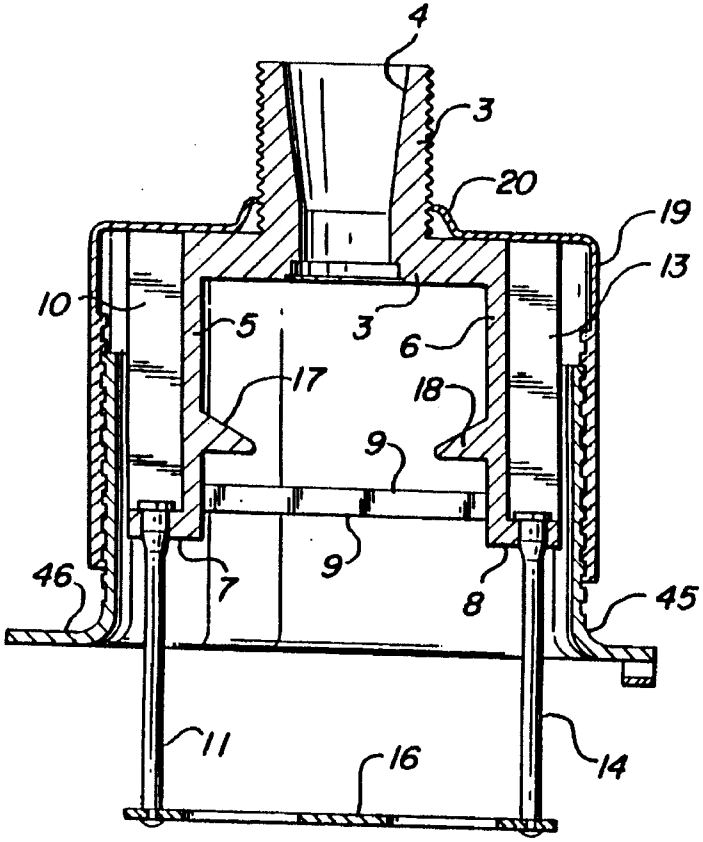
FIG-3

FIRE EXTINGUISHER SPRINKLER CONSTRUCTION

This is a divisional of U.S. application Ser. No. 08/001,162 filed Jan. 6, 1993, U.S. Pat. No. 5,299,645.

This invention relates to an automatically operable fire extinguishing sprinkler and more particularly to such a sprinkler that normally is inactive, but which is activated automatically in response to an increase in ambient temperature to a predetermined level.

BACKGROUND OF THE INVENTION

A conventional, automatically operable sprinkler comprises a supporting frame having a body formed of relatively non-corrosive metal that is adapted to be coupled to a water or other fire extinguishing fluid pipe in such position as to enable the sprinkler, when actuated, to discharge pressurized fluid in a pattern which, in conjunction with other sprinklers, enables the fluid to saturate a selected area. A conventional sprinkler includes a closure for the fluid passage which normally seals the passage and prevents the flow of fluid therethrough. The closure is maintained in its passage-sealing position by means of a collapsible strut which bears against the closure and a part of the sprinkler frame spaced from the closure. Such a sprinkler frame includes a pair of spaced apart legs joined at corresponding ends to the body and at their opposite ends by a cross bar provided with an adjusting screw that is movable toward and away from the closure and which bears against the opposite end of the strut.

The strut typically is one which includes a eutectic substance that reacts in response to a rise in its temperature to a predetermined level to cause the strut to collapse, thereby removing the restraining force on the closure, whereupon the pressure of fluid in the sprinkler system is able to unseat the closure and permit fluid to flow through the passage for discharge in the selected pattern. In most instances the fluid issuing from the passage impinges upon a deflector which causes the fluid to be discharged in the desired pattern.

A sprinkler of the kind referred to has the disadvantage that the legs of the supporting frame lie in the path of fluid discharged from the passage. Consequently, some of the fluid discharged from the frame passage impinges upon the arms and causes gaps in the coverage pattern.

In many instances the collapsible strut that is used to maintain the closure in its passage-sealing position comprises a glass tube within which is sealed a liquid which expands in response to its reaching a predetermined increased temperature level so as to rupture the glass tube, thereby enabling the closure to move off its passage-sealing seat. Although the glass forming the bulb is quite strong, the necessity of having to apply a direct force on the bulb to enable it to maintain the closure in its passage-sealing position makes possible the application of either too much or too little force on the bulb. If too much force is applied, the bulb may break prematurely. If too little force is applied, changes in temperature of the associated parts and differences in coefficients of thermal expansion of the several parts of the sprinklers can cause a passage-sealing closure to leak.

Some of the conventional sprinklers utilizing collapsible or frangible glass bulb struts have one end thereof seated directly on the passage-sealing closure. In many instances such a closure is in direct contact with the fire extinguisher fluid contained in the fluid system. In those instances in which the closure is of good thermal conductivity, heat from the strut is transmitted through the closure to the extinguishing fluid. Since the temperature of the extinguishing fluid usually is lower than that at which the strut collapses, the strut is cooled because of its contact with the closure. Consequently, the strut does not always collapse at the predetermined temperature, but must be heated to an even higher temperature in order to function properly.

SUMMARY OF THE INVENTION

A fire extinguishing sprinkler constructed in accordance with the preferred embodiment of the invention comprises a frame adapted to be coupled to an extinguishing fluid delivery system and having a fluid passage that normally is closed by a closure. The frame has a pair of legs which straddle the passage. A retainer for maintaining the closure in its passage-sealing position comprises a bowed member having a pair of spaced, parallel limbs joined at corresponding ends by a bight that bears upon the closure. The opposite ends of the bowed retainer member are free and such member is formed of a springy material which normally biases the free ends of the retainer toward one another. The free ends of the retainer are maintained in spaced apart relation by a collapsible strut that preferably comprises a frangible glass bulb containing a eutectic liquid which expands in response to a predetermined temperature rise and bursts the glass bulb so as to collapse the strut and enable the free ends of the retaining member to move toward one another.

Each limb of the retaining member has a part which nests with companion parts on the legs of the sprinkler frame and cooperates therewith to maintain the retaining member in bearing relation with the passage closure so as to seal the passage until such time as the frangible bulb collapses.

The passage closure is formed of a material which has poor thermal conductivity, thereby preventing the transfer of heat through the closure.

Upon collapse of the frangible strut and consequent unsealing of the passage-sealing closure, fire extinguishing fluid is discharged from the passage along a path. No part of the sprinkler frame lies in the path of the fluid stream, thereby avoiding gaps in the pattern of the fluid discharged from the sprinkler.

The passage-sealing closure also is adapted for retrofitting in conventional sprinklers of the kind wherein the collapsible strut bears directly on the passage closure. When the closure constructed in accordance with the invention is used in such a conventional sprinkler, the poor thermal conductivity of the closure avoids cooling of the strut by the temperature of the fluid that contacts the closure.

THE DRAWINGS

Apparatus constructed in accordance with a preferred embodiment of the invention is disclosed in the accompanying drawing wherein:

FIG. 1 is a vertical sectional view through the sprinkler and showing the parts thereof in their normal or inactive position;

FIG. 2 is a sectional view, on a reduced scale, taken on the line 2—2 of FIG. 1;

FIG. 3 is a view similar to FIG. 1, but illustrating the parts of the sprinkler in the positions they occupy when the sprinkler has been activated;

THE PREFERRED EMBODIMENT

Figure 4:
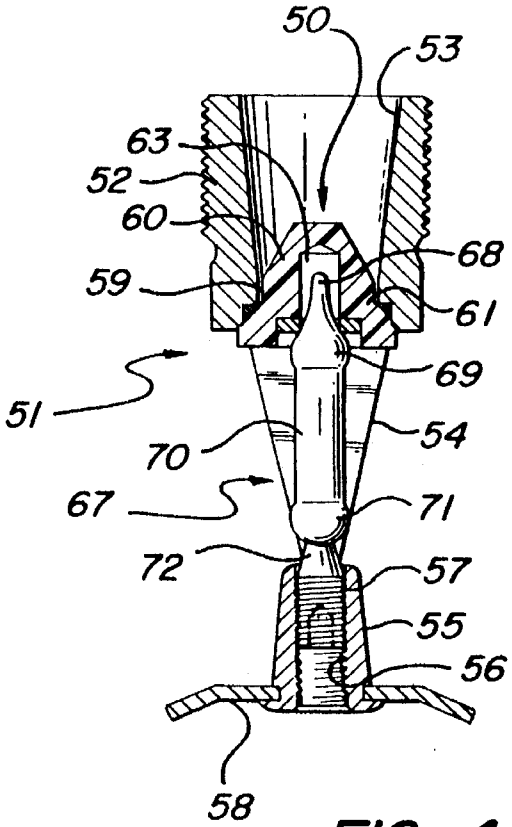
FIG. 4 is a vertical sectional view through a conventional sprinkler utilizing a frangible bulb as a collapsible strut for maintaining a fluid passage-sealing closure in sealing position, the closure being constructed in accordance with the invention.

A sprinkler constructed in accordance with the embodiment shown in FIGS. 1–3 comprises a frame 1 formed of a suitable, non-corrosive material such as brass. The frame has an enlarged head 2 at one end from which extends an externally threaded coupling 3 having a fluid passage 4 therein. The coupling is adapted to be fitted into a correspondingly threaded outlet in a water or other fire extinguishing pipe (not shown) forming part of an extinguishing fluid delivery system.

Projecting from the head 2 in the opposite direction is a pair of parallel, spaced apart legs 5 and 6. The leg 5 terminates in a free end 7 and the leg 6 terminates in a free end 8 which is coplanar with the end 7. The ends of the legs are coupled by arcuate spanners 9.

The leg 5 has a vertically extending groove 10 in which is slideably accommodated a rod 11 which extends through an opening 12 at the base of the groove. The leg 6 has a similar groove 13, a similar rod 14 and a similar opening 15 through which the rod 14 slideably extends. The rods 11 and 14 are spanned at their lower ends by a deflector 16.

The leg 5 has between its ends a projection 17 which extends in a directions toward the leg 6, and the leg 6 has a similar projection 18 which extends toward and is at the level of the projection 17.

In the embodiment disclosed in FIGS. 1 and 3 the frame 1 is enclosed within a cup-shaped housing 19 terminating at one end in a fitting 20 that is threaded onto the coupling 4 and is open at its opposite end. The housing 19 is not an essential part of the sprinkler, but can be used in those instances in which the sprinkler occupies a position within a recessed opening formed in a room ceiling or other support.

Removably accommodated in the fluid passage 4 is a closure 21 comprising a plug having an axially central, cylindrical body portion 22 which has a sliding fit with the wall of the passage 4. On opposite sides of the body portion 22 are frusto-conical portions 23 and 24, the portion 24 being of greater diameter than the portion 23. The conical portion 24 terminates in an enlarged head 25 that is slideably accommodated in a counterbore 26. The conical portion 24 also bears against a sealing O-ring 27 seated at the base of the counterbore.

In the embodiment shown in FIG. 1 the closure 21 has an axially extending, blind bore 28 in communication with the counterbore 26. In communication with the blind bore is a counterbore 29 having a flat surface which is seated a cylindrical insert or pad 30.

The closure plug is formed of a material, such as polyphenylene sulphide, which is of poor thermal conductivity. The pad 30 is formed of metal, such as brass, which is much harder than the material forming the closure 21 and is thus less susceptible to creep or deformation in response to temperature variation and sustained application of force.

The pressure of fire extinguishing fluid in the fluid supply system and in the passage 4 conventionally is sufficient to dislodge the closure 21 from the passage. Accordingly, retaining means 31 is provided for maintaining the closure 21 in its passage-sealing position until such time as the ambient temperature increases to a predetermined level.

The retaining means 31 comprises a bowed, metallic spring member 32 of good thermal conductivity having a pair of spaced apart limbs 33 and 34 joined at corresponding ends by a bight. 35. The limb 33 has a knee 36 which partially nests with the frame projection 17 and the limb 32 has a detent 37 which nests with the leg projection 18. The bight 35 may bear directly against the pad 30 or, as shown in FIG. 1, a bellville washer 38 may be interposed between the bight 35 and the pad 30 so as to maintain the parts 36 and 37 firmly seated with respect to the respective projections 17 and 18.

The limbs of the spring member 32 have free ends 39 and 40 which tend to move toward one another. The limbs 33 and 34 normally are maintained in their spaced apart relation by a thermally sensitive, collapsible strut 41 comprising a sealed glass tube 42 one end of which seats in a dimple (not shown) formed in the limb 34. The opposite end of the tube extends into a cup that is accommodated within an opening in the limb 33. If desired, the tube 42 may have an enlargement 44 between its ends which bears against the cup 43, and the overall length of the tube 42 is sufficient to maintain the respective limbs in snug engagement with the projections 17 and 18. The enlargement 44 is not essential.

In some instances it is preferred to place the sprinkler in a cavity formed in a ceiling or wall of a building. In those instances the cup 19 may be provided with a sleeve 45 which is threadedly or otherwise suitably accommodated within the cup 19. The sleeve has a flange 46 at its lower end which provides a finish edge that may overlie the ceiling or wall material adjacent the cavity in which the sprinkler is located. The flange may be provided with a plurality of circumferentially spaced, low temperature-melting solder connectors 47 to which is secured a thin cover 48 that normally overlies the sprinkler and conceals it from view.

For purposes of illustration, the cover 48 is shown in vertically spaced relation to the deflector 16. In final assembly, however, the cover will bear against the deflector so as to support the latter in the position shown in FIG. 1.

When the sprinkler is installed as part of the fire protection system, the passage 4 will be in direct communication with the source of fire extinguishing fluid, the closure 21 will be in its passage-sealing position, and the retaining member 31 will be in the position shown in FIG. 1 in which it reacts between the frame projections 17 and 18 and the closure 21 to maintain the latter in sealing relation with respect to the passage 4. The collapsible strut 41 will be in the position shown in FIG. 1 in which it maintains the limbs 33 and 34 spaced apart and in snug engagement with the respective projections 17 and 18. The sleeve 45 will be accommodated and retained within the cup 19 with the cover 48 in engagement with the deflector 16.

When the ambient temperature of the room in which the sprinkler is installed rises to the melting temperature of the solder connections 47 they will melt, thereby releasing the cover 48. The deflector 16 then is free to move downwardly by gravity from the position shown in FIG. 1 to the position shown in FIG. 3. If the temperature continues to rise, and should the temperature reach the predetermined level at which the eutectic liquid in the tube 42 expands, the tube 42 will disintegrate, thereby collapsing the strut whereupon the springiness of the material from which the member 32 is formed causes the limbs 33 and 34 to move toward one another and disengage the respective projections 17 and 18.

The pressure of fluid in the passage 4 then will be able to expel the closure 21 from the passage, thereby enabling fire extinguishing fluid to flow through the passage along a path toward the deflector 16. The deflector will distribute the fluid discharged from the passage 4 in accordance with a predetermined pattern.

A particularly advantageous characteristic of the invention is that no part of the sprinkler frame lies in the path of the stream of fluid discharged from the passage 4. Thus, no part of the frame interferes with the distribution of the fire extinguishing fluid and the pattern of the discharged fluid as determined by the configuration of the deflector 16.

Another significant characteristic of the invention is that, even though the temperature of fluid in the passage 4 may be much lower than that of the ambient temperature to which the strut 41 is exposed, and even though the retaining member 32 has good thermal conductivity, the poor thermal conductivity of the closure plug 21 prevents the transmission of heat from the strut to the fluid. Consequently, the strut will collapse at a temperature corresponding more closely to the temperature at which the strut is rated than otherwise would be the case.

A further important characteristic of the invention is that, since the strut 41 is not subjected to a rigid, manually applied force such as that applied by an adjustable set screw, the glass forming the tube 42 may have a wall that is considerably thinner than that of conventional glass struts. As a consequence, the liquid within the tube has a lower response time to ambient temperature increases.

Figure 5:
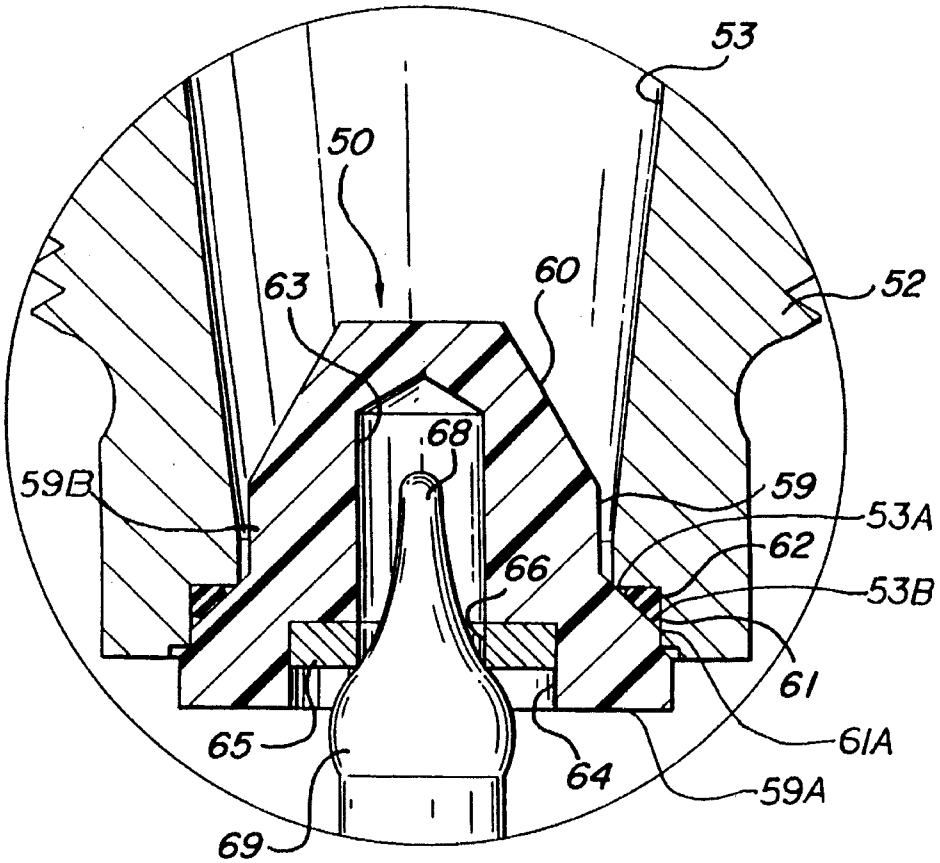
FIG. 5 is an enlarged cross sectional view of a portion of the structure shown in FIG. 4.

The principles underlying the construction of the closure 21 are applicable to other kinds of sprinkler constructions. For example, FIGS. 4 and 5 illustrate a closure 50 corresponding substantially to the earlier described embodiment herein, but adapted for use with a prior art sprinkler such as that shown in U.S. Pat. No. 4,109,727.

In the embodiment shown in FIGS. 4 and 5 the sprinkler comprises a frame 51 having an externally threaded coupling 52 adapted to be fitted to a fire extinguishing fluid supply system. The coupling forms a passage 53 through which fluid may be discharged in a path. The coupling 52 is secured to a pair of spaced apart legs 54 that extend in a direction away from the coupling 52 and are joined at corresponding ends by a fitting 55 having an internally threaded bore 56 in which a correspondingly threaded adjusting screw 57 is accommodated. The fitting also supports a deflector 58.

The closure 50 has a central body 59 forming a plug, one end of which extends axially into the passage 53 and the other end of which terminates in an enlarged head 59*a* which extends laterally beyond the passage and seats on the coupling 52. The body 59 has a central cylindrical section 59*b* at opposite ends of which are frusto-conical sections 60 and 61. The section 61 terminates adjacent the head 59a in a short cylindrical section 61*a*. Adjacent the outlet end of the passage 53 is a counterbore 53*a* having a cylindrical perimeter wall 53*b* which is engaged by the section 61*a* of the head 59*a*. Occupying the counterbore 5*a* is a sealing 0ring 62 which is sealingly engaged by the conical section 61. As clearly is shown in FIG. 5, the O-ring 62 is compressed between the walls of the counterbore 53*a*, and the cylindrical section 61*a* engages the perimeter wall 53 of the counterbore 53*a*.

The closure 50 has a blind bore 63 in communication with a counterbore 64 formed in the outer surface of the enlarged head 59*a*. Accommodated in the counterbore is a metallic pad 65 like the pad 30, except that the pad 65 has an opening 66 in register with the bore 63.

A frangible, thermally sensitive strut 67 has a tapered tip 68 at one end which extends through the opening 66 in the pad 65 into the bore 63. If desired, an enlargement 69 between the ends of the strut bears against the pad 65 to limit the extent to which the tip extends into the bore 63, but such enlargement is not essential. The strut 67 has a cylindrical body portion 70 which extends from the enlargement 69 and preferably terminates in a second enlargement 71 which is engageable by the tip 72 of the adjusting screw 57 so as to apply a sufficient force on the closure 50 to maintain the latter in its passage-sealing position. Again, the enlargements 69 and 71 are not essential.

The strut 67 preferably comprises a sealed, hollow glass tube and contains a eutectic liquid which expands at a predetermined, elevated temperature.

Normally, the parts of the sprinkler occupy the positions shown in FIG. 4 so as to maintain the closure 50 in its passage-sealing position. In response to a rise in ambient temperature to the level at which the eutectic liquid expands, the strut 67 will collapse, thereby enabling the force of fire extinguishing fluid in communication with the bore 53 to dislodge the closure 50 and fire extinguishing liquid to be discharged from the bore along the path that leads to the deflector 58.

The closures 21 and 50 are identical except that the pad 65 for use with the closure 50 is provided with the opening 66 so as to enable the tip of the strut to extend into the bore 63. Obviously, the closure 21 is not required to include the bore 28, but making both closures alike enables either closure to be used with each of the two sprinklers disclosed herein.

The closure 50, like the closure 21, is formed of a material of poor thermal conductivity, thereby preventing the strut 67 from being cooled by the lower temperature of the fluid in the passage 53.

The disclosed embodiments are representative of presently preferred forms of the invention, but are intended to be illustrative rather than definitive thereof. The invention is defined in the claims.

We claim:

1. In fire extinguishing sprinkler apparatus of the kind having a frame adapted for connection to a source of fire extinguishing fluid and a passage in said frame through which said fluid may flow axially along a path, a closure normally occupying a position closing said passage and in contact with said fluid but being removable from said position in response to the flow of said fluid through said passage, and a collapsible strut reacting between said frame and said closure and normally maintaining said closure in said passage closing position, said strut being responsive to an increase in temperature to a predetermined level to disengage said closure and enable said fluid to flow through said passage, the improvement wherein said frame has a counterbore having a cylindrical perimeter wall, said counterbore being in communication with said passage, said closure comprising a body having at one end extending axially into said passage and terminating at its other end in an enlarged head having a diameter exceeding that of said perimeter wall of said counterbore and seated on said frame, said body having a side wall between its ends, said side wall having a cylindrical section adjacent said head and a tapered section adjacent said cylindrical section, said cylindrical section having a diameter corresponding to that of said perimeter wall of said counterbore and in engagement therewith, said tapered section of said side wall providing a space between itself and said perimeter wall of said counterbore, a sealing ring encircling said tapered section and accommodated in said space to form a seal between said body and said counterbore, said body being formed of material of insufficient thermal conductivity to transmit heat from said strut to said fluid.

2. The apparatus according to claim 1 wherein the head of said body has a seat confronting said strut and an insert occupying said seat on which said strut bears.

3. The apparatus according to claim 2 wherein said body has a blind bore extending inwardly of said body from said seat.

4. The apparatus according to claim 2 wherein said insert is formed of material having good thermal conductivity.

5. The apparatus according to claim 1 wherein said body has a blind bore extending inwardly from said head, said strut having a tapered tip which extends partially into said blind bore.

6. The apparatus according to claim 5 wherein said head has a counterbore in communication with said blind bore and an insert accommodated in the counterbore in said head, said insert having an opening in communication with said blind bore and through which said tapered tip of said strut extends.

7. The apparatus according to claim 5 wherein said insert is formed of metal having good thermal conductivity.

* * * * *